US005399822A

United States Patent [19]

Sato et al.

[11] Patent Number: 5,399,822

[45] Date of Patent: Mar. 21, 1995

[54] KEYSWITCH DEVICE

[75] Inventors: Yoshitsugu Sato, Kuwana; Isao Mochizuki, Kaizu; Makoto Watanabe, Nagoya, all of Japan

[73] Assignee: Brother Kogyo Kabushiki Kaisha, Nagoya, Japan

[21] Appl. No.: 87,906

[22] Filed: Jul. 9, 1993

[30] Foreign Application Priority Data

Jul. 17, 1992 [JP] Japan ..... 4-213356

[51] Int. Cl.[6] ..... H01H 13/70

[52] U.S. Cl. ..... 200/344; 200/345; 200/520

[58] Field of Search ..... 200/344, 343, 341, 345, 200/520, 521, 534, 515, 517

[56] References Cited

U.S. PATENT DOCUMENTS

| | | | |
|---|---|---|---|
| 2,550,250 | 4/1951 | Huppert | 200/508 |
| 3,174,685 | 3/1965 | Swanson | 235/55 R |
| 3,849,611 | 11/1974 | Walker, Jr. | 200/5 A |
| 4,433,225 | 2/1984 | Cowles | 200/344 |
| 4,560,844 | 12/1985 | Takamura et al. | 200/5 A |
| 4,560,845 | 12/1985 | Takamura et al. | 200/5 A |
| 4,580,022 | 4/1986 | Oelsch et al. | 200/344 |
| 4,735,520 | 4/1988 | Suzuki et al. | 400/488 |
| 4,902,862 | 2/1990 | Oelsch et al. | 200/344 |

FOREIGN PATENT DOCUMENTS

| | | |
|---|---|---|
| 60-62017 | 4/1985 | Japan . |
| 64-7441 | 1/1989 | Japan . |
| 2-5236 | 1/1990 | Japan . |

*Primary Examiner*—Henry A. Recla
*Assistant Examiner*—David J. Walczak
*Attorney, Agent, or Firm*—Oliff & Berridge

[57] ABSTRACT

A keyswitch device has a good operational feeling in a keytop and is easily and simply assembled. When the keyswitch device is assembled, the engaging pins 55, 56 of the hinge member 47 and the engaging rod 61 of the hinge member 48 are slid on the holder plate 65 toward the open sides of the sliding slots 68, 69 in the holding portions 66, 67 while being guided through the guiding walls 73 . Further, the engaging pins 55, 56 and the engaging rod 61 are slid until the engaging rod 61 rides over the stopper 69A formed in the sliding slot 69. When the guide support member 46 and the keytop 41 are connected with each other, after the engaging rod 53 of the hinge member 47 is opposed to the vertical slot 44 of the keytop 41 and the engaging pins 63, 64 of the hinge member 48 are opposed to the long slot 45 of the keytop 41, the keytop 41 is slightly pressed downwardly. Accordingly, the engaging rod 53 of the hinge member 47 is snappped into the vertical slot 44 while being guided through the guide portion 44A and at the same time the engaging pins 63, 64 of the hinge member 48 are snapped into the long slot 45 while being guided through the guide portion 45A. Thus, not only the guide support member 46 and the holder plate 65 but also the guide support member 46 and the keytop 41 can be easily connected with each other.

19 Claims, 6 Drawing Sheets

KEYSWITCH DEVICE

BACKGROUND OF THE INVENTION

1. Field of the Invention

The present invention relates to a keyswitch device having a keytop, which is supported so as to be slidably guided to both upward and downward directions through a support member arranged on a keyholder plate. More particularly, the invention relates to a keyswitch device with good operational feeling of the keytop, in which assembly of the support member, the keyholder plate, the support member and the keytop can be easily done.

2. Description of Related Art

Conventionally, various kinds of keyswitch devices have already been proposed. In such keyswitch devices, in general, that a keystem formed from a back surface of a keytop is slidably guided to upward and downward directions through a key guiding portion formed on a keyholder plate.

In the keyswitch devices having such construction, operational feeling of the keytop is improved when the key guiding portion of the keyholder plate, through which the keystem is slidably guided, is lengthened. Such a lengthened key guiding portion, on the contrary, cannot be adopted for keyboards which recently have a tendency to be thinned. On the other hand, there is the dilemma that operational feeling of the keytop is deteriorated because the keystem is inclinedly guided relatively to the key guiding portion while contacting with each other if the key guiding portion is shortened in order to correspond to thinning tendency of the keyboards.

In order to dissolve the above dilemma existing in the conventional keyswitch devices, applicant of the present invention proposed, in U.S. Pat. Nos. 5,278,372, and 5,280,147, a keyswitch device capable of corresponding to thinning tendency of the keyboards and accomplishing good operational feeling of the keytop by removing both the keystem and the key guiding portion therefrom. Such keyswitch device is shown in FIGS. 9 to 11. Construction of the keyswitch device will be summarized hereinafter.

In FIG. 9, a resinous keytop 1 has two holding portions 2 and 3 which are formed from back surface of the keytop 1. Here, each of the holding portions 2 and 3 exists in a pair, respectively. And an engaging hole 4 is formed in the holding portion 2 and an engaging slot 5 is formed in the holding portion 3. Further, a resinous holder plate 25 on which two holding portions 26, 27 are formed, is arranged under the keytop 1. Here, each of the holding portions 26 and 27 exists in a pair, respectively. In the holding portion 26, an engaging slot 28 is formed and, in the holding portion 27, an engaging hole 29 is formed. Between the keytop 1 and the holder plate 25, a guide support member 6 is arranged. The guide support member 6 comprises two hinge members 7 and 8. Both the hinge members 7 and 8 are crossedly supported at a supporting part A, as mentioned hereinafter. The hinge member 7 has a pair of engaging pins 13 and 14 at one end thereof and a pair of another engaging pins 15 and 16 at the other end thereof. Each of the engaging pins 13 and 14 is engaged into the engaging hole 4 and each of the engaging pins 15 and 16 is engaged into the engaging slot 28. And the hinge member 8 has a pair of engaging pins 21 and 22 at one end thereof and a pair of engaging pins 23 and 24 at the other end thereof. Each of the engaging pins 21 and 22 is engaged into the engaging hole 29 and each of the engaging pins 23 and 24 is engaged into the engaging slot 5. According to the above construction of the keyswitch device, the keytop 1 is guided to both upward and downward directions through the guide support member 6.

The supporting part A, where the hinge member 7 and the hinge member 8 are crossedly supported with each other, is put on top of a rubber spring 31 mounted on a flexible circuit board 30 installed on a supporting plate 32. Thus, when the keytop 1 is depressed, the supporting part A depresses the rubber spring 31 so as to be buckled for switching action.

Here, as shown in FIG. 10, the hinge member 7 has a base part 9 at both ends of which two base end portions 10 and 11 are formed into one body. From one side surface of central position of the base part 9, a shaft 12 which is supported into a shaft hole 20 (later mentioned) of the hinge member 8 is extended. And the engaging pins 13 and 14 are extended from each of side surfaces of extending portions 10A formed from both sides of the base end portion 10. Each of the engaging pins 13, 14 is engaged into the engaging hole 4 formed in the holding portion 2 of the keytop 1. Further, the base end portion 11 is shaped like a U, as shown in FIG. 10, and the engaging pins 15 and 16 are extended from each of side surfaces of extending portions 11A formed from both sides of the base end portion 11. Each of the engaging pins 15, 16 is engaged into the engaging slot 28 formed in the holding portion 26 of the holder plate 25 so that each of the engaging pins 15, 16 becomes slidable in the engaging slot 28.

And as shown in FIG. 11, the hinge member 8 has a base part 17 at both ends of which two base end portions 18 and 19 are formed into one body. In the central position of the base part 17, a shaft hole 20, into which the shaft 12 formed in the base part 9 of the hinge member 7 is inserted, is bored. The base end portion 18 is shaped like a U, as shown in FIG. 11, and the engaging pins 21 and 22 are extended from each of side surfaces of extending portions 18A formed from both sides of the base end portion 18. Each of the engaging pins 21, 22 is engaged into the engaging hole formed in the holding portion 27 of the holder plate 25. Further, the engaging pins 23 and 24 are extended from each of side surfaces of extending portions 19A formed from both sides of the base end portion 19. Each of the engaging pins 23, 24 is engaged into the engaging slot 5 formed in the holding portion 3 of the keytop 1 so that each of the engaging pins 23, 24 becomes slidable in the engaging slot 5.

As mentioned above, the guide support member 6 is constructed so that the shaft 12 extended from the base part 9 of the hinge member 7 is inserted into the shaft hole 20 bored in the base part 17 of the hinge member 8, therefore each of both the hinge members 7, 8 becomes rotatable with each other through supporting part A constructed from both the shaft 12 of the hinge member 7 and the shaft hole 20 of the hinge member 8.

According to the keyswitch device constructed above, a keyswitch device can be constructed with good operational feeling of the keytop 1, which is able to correspond to thinning tendency of keyboards.

However, there is a problem in the conventional keyswitch device mentioned above that assembly of not only the holder plate 25 and the guide support member 6 including the hinge member 7 and the hinge member 8 but also the guide support member 6 and the keytop 1 cannot be easily or simply done.

That is to say, when the keyswitch device is assembled, at first, the guide support member 6 is assembled by crossedly combining the hinge member 7 and the hinge member 8 through the shaft 12 and the shaft hole 20. Thereafter, the engaging pins 21, 22 extended from the base part 18 of the hinge member 8 are pressed into the engaging hole 29 of the holding portion 27 formed on the holder plate 25. At that time, though pressing of the engaging pins 21, 22 into the engaging hole 29 is conducted by utilizing resinous elasticity of the extending portions 18A and the engaging pins 21, 22, it is difficult to correctly position the engaging pins 21, 22 in the engaging hole 29. Therefore, pressing action of the engaging pins 21, 22 into the engaging hole 29 is apt to be unstable and thus, such pressing action is considerably troublesome.

Thereafter, the engaging pins 15, 16 extended from the base end portion 11 of the hinge member 7 are pressed into the engaging slot 28 of the holding portion 26. In this case, since pressing action of the engaging pins 15, 16 into the engaging slot 28 is conducted by utilizing resinous elasticity of the extending portions 11A and the engaging pins 15, 16, pressing action is considerably troublesome similar to pressing action of the engaging pins 21, 22.

After finishing the connecting action between the hinge members 7, 8 and the holding portions 26, 27 of the holder plate 25, both the pressing action of the engaging pins 13, 14 in the hinge member 7 into the engaging hole 4 of the holding portion 2 and the pressing action of the engaging pins 23, 24 in the hinge member 8 into the engaging slot 5 of the holding portion 3 are conducted. Since the thus pressing actions are also conducted by utilizing resinous elasticity of the engaging pins 13, 14, 23, 24 and the holding portions 2, 3, such pressing actions become considerably troublesome, similar to the above.

As mentioned above, in the above constructed conventional keyswitch device, there is a problem that it is necessary to conduct the troublesome pressing actions over assembling of the keyswitch device, since connecting of the hinge members 7, 8 of the guide support member 6 to both the holder plate 25 and the keytop 1 is realized by utilizing resinous elasticity. Further, the engaging pins 13 to 24 are necessary to be engaged into the engaging holes 4, 29 and the engaging slots 5, 28 while correctly positioning thereof.

SUMMARY OF THE INVENTION

Accordingly, it is an object of the present invention to overcome the above mentioned problem and to provide a keyswitch device with good operational feeling of a keytop in which assembly of not only a guide support member and a holder plate but also a guide support member and a keytop can be easily and simply conducted.

To accomplish the above object, the present invention provides a keyswitch device comprising :

a keytop having a pair of first holding portions and a pair of second holding portions formed from back surface thereof, a holder member having a pair of third holding portions formed thereon at diagonal positions of the first holding portions and a pair of fourth holding portions formed thereon at diagonal positions of the second holding portions, the holder member being arranged under the keytop, a guide support member for guiding the keytop to upward and downward directions, the guide support member having a first hinge member including a first engaging rod rotatably engaged into the first holding portions and a pair of third engaging pins slidably engaged into the third holding portions and a second hinge member including a pair of second engaging pins slidably engaged into the second holding portions and a fourth engaging rod rotatably engaged into the fourth holding portions, the first and the second hinge members being rotatably supported with each other, a switching means for conducting switching action according to movement of the keytop, wherein each of the third holding portions and the fourth holding portions has a sliding slot formed therein which is opened at one side and both the third engaging pins and the fourth engaging rod are slid into the sliding slots from the opened sides.

According to the present invention, when the keyswitch device is assembled, the first hinge member and the second hinge member are rotatably supported with each other. Thereafter, both the third engaging pins of the first hinge member and the fourth engaging rod of the second hinge member are slid into the sliding slots from the opened sides thereof. At that time, the third engaging pins and the fourth engaging rod are slid into the sliding slots only by sliding the third engaging pins and the fourth engaging rod on the holder member toward the opened sides of the sliding slots. Thus, the first, the second hinge members and the holder member are easily connected.

And when switching action is conducted in the keyswitch device constructed above, the keytop is depressed. According to depression of the keytop, the keytop is moved downwardly by being guided through the guide support member. Based on such movement of the keytop, switching action is conducted through the switching means.

The above and further objects and novel features of the invention will more fully appear from the following detailed description when the same is read in connection with the accompanying drawings. It is to be expressly understood, however, that the drawings are for purposes of illustration only and not intended as a definition of the limits of the invention.

BRIEF DESCRIPTION OF THE DRAWINGS

The invention will be described with reference to the following drawings, wherein.

DETAILED DESCRIPTION OF THE PREFERRED EMBODIMENTS

A detailed description of the preferred embodiment according to the present invention will now be given referring to the accompanying drawings.

Figure 1:
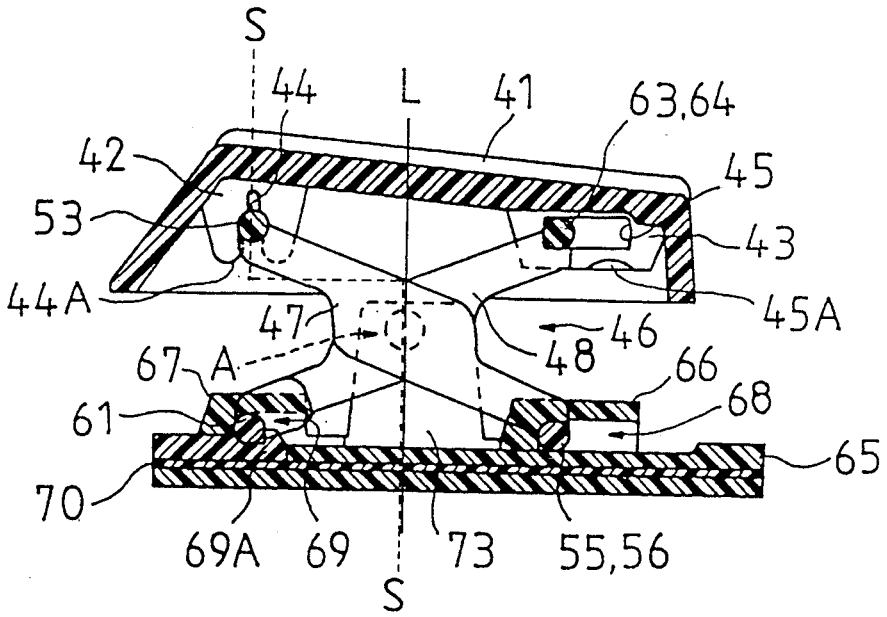
FIG. 1 is a vertical sectional view of a keyswitch device.

In FIG. 1, a keytop 41 is molded from synthetic resin such as Acrylonitrile-Butadiene-styrene resin (ABS resin) and on a top surface of the keytop 1, a character such as alphabet or the like is formed by printing. And from the under surface of the keytop 1, two holding portions 42 and 43 are extended to the downward direction. Here, each of the holding portion 42 and 43 exists in a pair extending in to a vertical direction penetrating the drawing sheet, and only ones of the holding portions 42 and 43 are shown in FIG. 1.

In the holding portion 42, a vertical slot 44 into which a engaging rod 53 formed in one hinge member 47 (later mentioned) is rotatably engaged is formed and in the holding portion 43, a lateral long slot 45 into which two engaging pins 83, 64 formed in the other hinge member 48 (later mentioned) are slidably engaged is formed.

In the vertical slot 44, a guide portion 44 A is formed, the guide portion 44A being continuously formed from the vertical slot 44 and being made open at the lower end so as to become gradually wider and wider according to the downward direction. The guide portion 44A is utilized for guiding the engaging rod 53 toward the vertical slot 44 when the engaging rod 53 is snapped into the vertical slot 44. Further, at the lower position of the long slot 45 in the holding portion 43, a guide portion 45A is formed, the guide portion 45A having an inclined surface which is outwardly inclined to the downward direction. That is to say, the guide portion 45A is tapered so that the thickness thereof becomes thinner and thinner to the downward direction. The guide portion 45A is utilized for guiding the engaging pins 63, 64 toward the long slot 45 when the engaging pins 63, 64 are snapped into the long slot 45.

Figure 2:
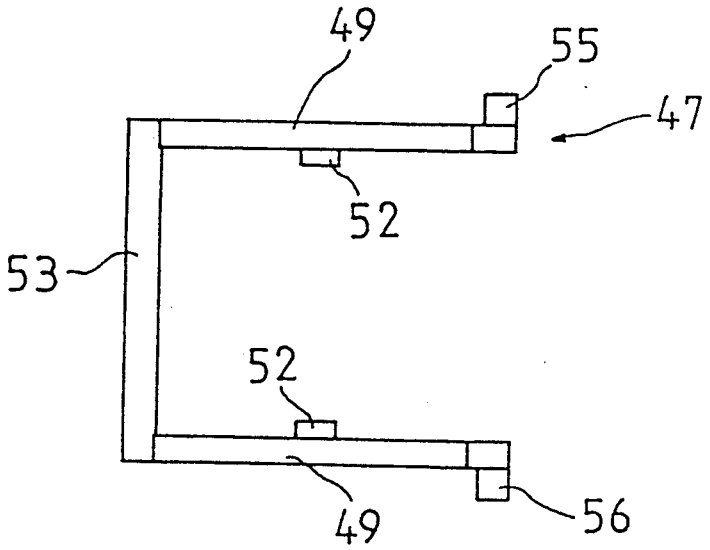
FIG. 2 is a plan view of one hinge member.

And under the keytop 41, a guide support member 46 which guides and supports the keytop 41 to both upward and downward directions is arranged. The guide support member 46 is constructed from two hinge members 47 and 48. One hinge member 47, as shown in FIG. 2, is shaped like a U, and has a pair of plates 49. Between one ends of the plates 49 the engaging rod 53 is formed into one body and at the other ends of the plates 49, engaging pins 55, 56 are outwardly formed. Here, the engaging rod 53 is snapped into the vertical slot 44 of the holding portion 42 through the guide portion 44A and the engaging pins 55, 56 are engaged into an engaging portion 66 formed in a holder plate 65 (later mentioned).

And from central inner sides opposing with each other on the plates 49, a pair of short shafts 52 are formed so that the shafts 52 are opposed with each other. These shafts 52 are supported in shaft holes 60 (later mentioned) formed in the hinge member 48. Here, the engaging rod 53 and the engaging pins 55, 56 are positioned in the hinge member 47 so that the distance between the engaging rod 53 and the shafts 52 becomes the same as the distance between the engaging pins 55, 56 and the shafts 52.

Figure 3:
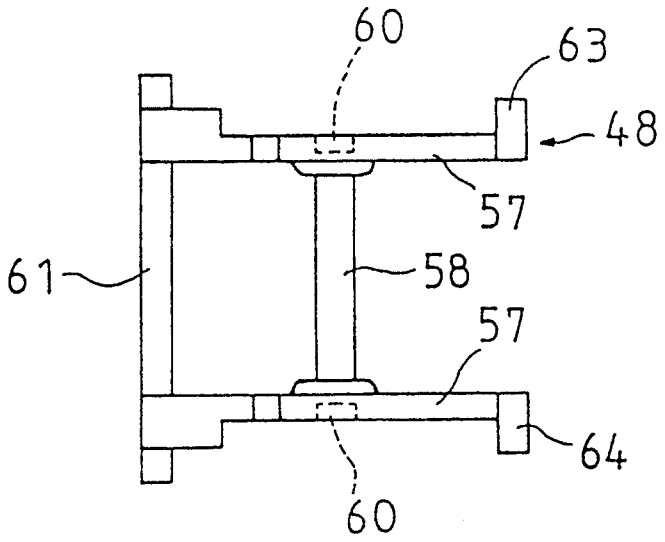
FIG. 3 is a plan view of the other hinge member.

Further, the other hinge member 48, as shown in FIG. 3, has a pair of plates 57. And between one ends of the plates 57, a engaging rod 61 is formed into one body therewith and between the other ends of the plates 57, a pair of engaging pins 63, 64 are formed outwardly. Here, both ends of the engaging rod 61 are engaged into a holding portion 67 formed on the holder plate 65 (later mentioned) and each of the engaging pins 63, 64 is snapped into the long slot 45 formed in the holding portion 43 through the guide portion 45A.

On an outer side of each of the plates 57, a shaft hole 60 is formed at a central position so that each of the shaft holes 60 is mutually opposed. In each of the shaft holes 60, the shafts 52 formed on the plates 49 in the hinge member 47 are rotatably supported, respectively. Thus, both the hinge member 47 and the hinge member 48 become rotatable because on that the hinge members 47, 48 are mutually supported in a crossed state through the shafts 52 and the shaft holes 60. Here, the supporting part A is constructed from the shafts 52 and the shaft holes 60. And the engaging rod 61 and the engaging pins 63, 64 are positioned in the hinge member 48 so that the distance between the engaging rod 61 and the shaft holes 60 becomes the same as the distance between the engaging pins 63, 64 and the shaft holes 60.

Further, between inner sides of the plates 57, a pressing rod 58 is formed at central positions of the plates 57. The pressing rod 58 is put on a rubber spring 71 (later mentioned) and presses the rubber spring 71 according to mutual rotation of both the hinge member 47 and the hinge member 48 when the keytop 41 is depressed. Therefore, switching action of the keyswitch device is conducted based on pressing action of the pressing rod 58 for the rubber spring 71 caused when the keytop 41 is depressed.

And the holder plate 65 is arranged under the guide support member 46 and the holding portion 66 and the holding portion 67 are formed on the holder plate 65 corresponding to each keyswitch device. Here, each of the holding portions 66 and 67 exists in a pair and each one of the holding portions 66, 67 is shown in FIG. 1.

In the holding portion 66, a sliding slot 68 which is opened at the right end thereof in FIG. 1, is formed and the engaging pins 55, 56 formed in the hinge member 47 are slidably supported. And in the holding portion 67, a sliding slot 69 which is opened at the right end thereof in FIG. 1, is formed similarly to the sliding slot 68 of the holding portion 66 and a stopper 69A having an inclined surface which is inclined at the right side thereof as shown in FIG. 1 is formed in the sliding slot 69. In the sliding slot 69 of the holding portion 67, both ends of the engaging rod 61 are snapped. And on the holder plate 65, a pair of guide walls 73 are arranged between the holding portion 66 and the holding portion 67 (see FIG. 4).

To link the guide support member 46 and the holder plate 65, the engaging pins 55, 56 in the hinge member 47 and the engaging rod 61 in the hinge member 48 are slid on the holder plate 65 while guiding the outer surfaces of the plates 49 in the hinge member 47 according to the guide walls 73 from the open sides (the right sides) of the sliding slots 68, 69 to the left sides thereof. Based on this action, the engaging pins 55, 56 and the engaging rod 61 are inserted into the sliding slot 68 and the sliding slot 69, respectively. At that time, after the engaging rod 61 is ridden over the stopper 69A in the sliding slot 69, the engaging rod 61 is never disengaged from the sliding slot 69. Therefore, the engaging rod 61 is rotatably retained in the sliding slot 69 and the engaging pins 55, 56 are slidably retained in the sliding slot 68, respectively.

Figure 4:
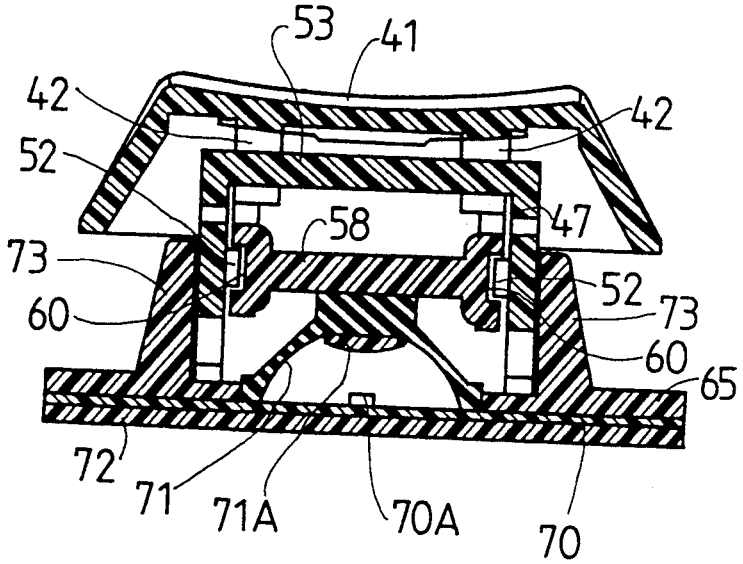
FIG. 4 is a transverse sectional view of the keyswitch device when sectioned according to line S—S in FIG. 1.

As shown in FIG. 4, the flexible circuit board 70 on which a fixed electrode 70A is formed corresponding to each keyswitch device, is located under the holder plate 65 and the rubber spring 71 formed of elastic rubber in the shape of an inverted cup is mounted on the flexible circuit board 70 corresponding to each fixed electrode 70A. Further, a movable electrode 71A is fixed to the inner upper wall of the rubber spring 71 so that the fixed electrode 70A and the movable electrode 71A are opposed with each other. And the pressing rod 58 formed in the hinge member 48 is disposed on the outer upper wall of the rubber spring 71.

According to the above construction, when the pressing rod 58 is moved downwardly based on depressing of the keytop 41, the rubber spring 71 is pressed by the pressing rod 58. Thereafter, the movable electrode 71A comes into contact with the fixed electrode 70A on the flexible circuit board 70 since the rubber spring 71 is buckled when pressing force to the rubber spring 71 is exceeded by a predetermined amount. As a result, switching action is conducted.

And a supporting plate 72 is arranged under the flexible circuit board 71 and the supporting plate 72 supports the flexible circuit board 71 and the holder plate 65 positioned thereover.

According to the above construction of the keyswitch device, as shown in FIG. 1, the vertical slot 44 for rotatably engaging the engaging rod 53 is formed in the holding portion 42 (located at the left side with reference to the vertical line L passing through the center of the support part A) extended from the back surface of the keytop 41. And the sliding slot 69 for rotatably engaging the engaging rod 61 in cooperation with the stopper 69A is formed in the holding portion 67 (located at the left side with reference to the vertical line L passing through the center of the support part A) formed on the holder plate 65. Further, the long slot 45 for engaging the engaging pins 63, 64 slidably to the lateral direction is formed in the holding portion 43 (located at the right side with reference to the vertical line L passing through the center of the support part A) extended from the back surface of the keytop 41 and the sliding slot 68 for engaging the engaging pins 55, 56 slidably to the lateral direction is formed in the holding portion 66 (located at the right side with reference to the vertical line L passing through the center of the support part A) formed on the holder plate 65.

In addition to the above, the assembling method of the above constructed keyswitch device will be given hereinafter referring to FIGS. 5 to 8. First, the flexible circuit board 70 and the holder plate 65 are disposed on the supporting plate 72. And the guide support member 46 is assembled by inserting the shafts 52 of the hinge member 47 into the shaft hole 60 of the hinge member 48.

Figure 5:
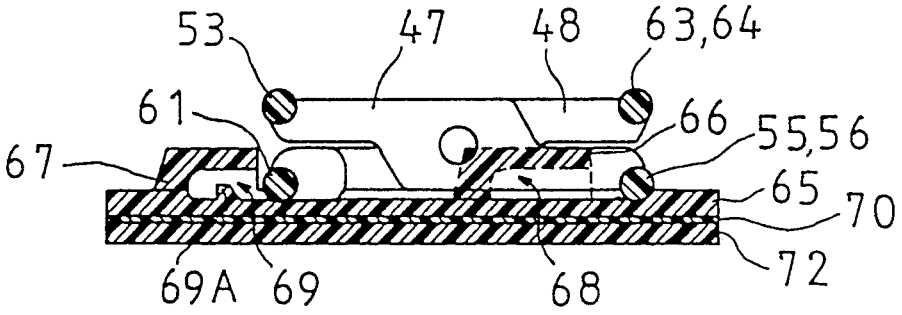
FIG. 5 is a schematic sectional view showing a state before a guide support member and a holder plate are connected.
Figure 6:
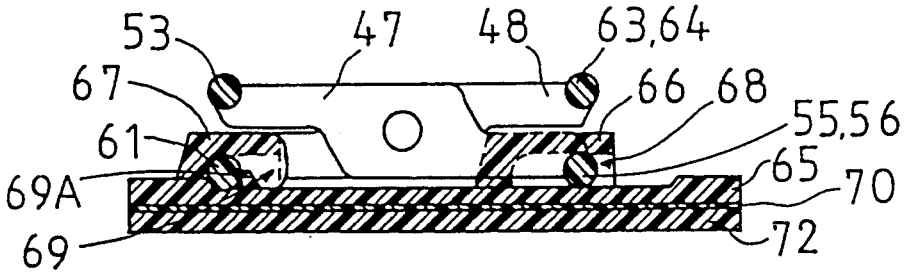
FIG. 6 is a schematic sectional view showing a state after the guide support member and the holder plate are mutually connected.

Thereafter, the hinge member 47 and the hinge member 48 are forced to a flat state as shown in FIG. 5 by rotating both the hinge members 47 and 48 with each other. And the engaging pins 55, 56 of the hinge member 47 and the engaging rod 61 of the hinge member 48 are slid on the holder plate 65, respectively toward the sliding slot 68 in the holding portion 66 and the sliding slot 69 in the holding portion 67 while guiding through the guiding walls 73 from the open sides of both the sliding slots 68, 69 to the left sides. And at a time when the guide support member 46 is slid furthermore, the engaging rod 61 of the hinge member 48 is ridden over the stopper 69A from the inclined surface. This state is shown in FIG. 6. As a result, connecting action of both the guide support member 46 and the holder plate 65 is finished.

Therefore, since not only connecting action of the engaging rod 61 of the hinge member 48 and the sliding slot 69 but also connecting action of the engaging pins 55, 56 of the hinge member 47 and the sliding slot 68 are realized only by sliding the guide support member 46 on the holder plate 65 from the open sides of the sliding slots 68, 69, connecting between the guide support member 46 and the holder plate 65 can be easily and simply done. At that time, since the guide support member 46 is guided through the guiding walls 73 while sliding thereof, the guide support member 46 is never disengaged from the sliding slots 68, 69. Accordingly, taking the action of the guiding walls 73 into consideration, connecting action between the guide support member 46 and the holder plate 65 can be more easily done.

Figure 7:
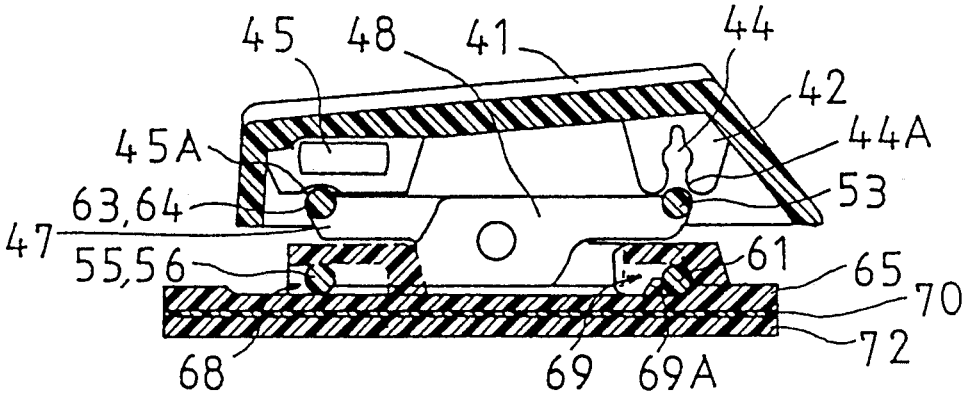
FIG. 7 is a schematic sectional view showing a state where the keytop is positioned on the guide support member connected to the holder plate.
Figure 8:
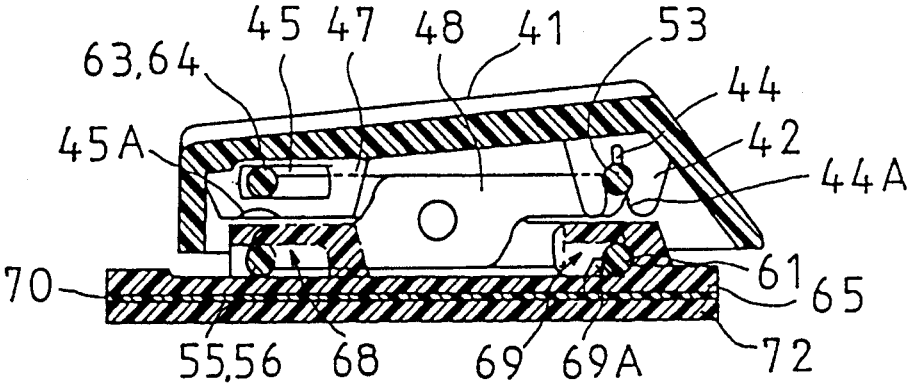
FIG. 8 is a schematic sectional view showing a state where the keytop is connected to the guide support member which is connected to the holder plate.
Figure 9:
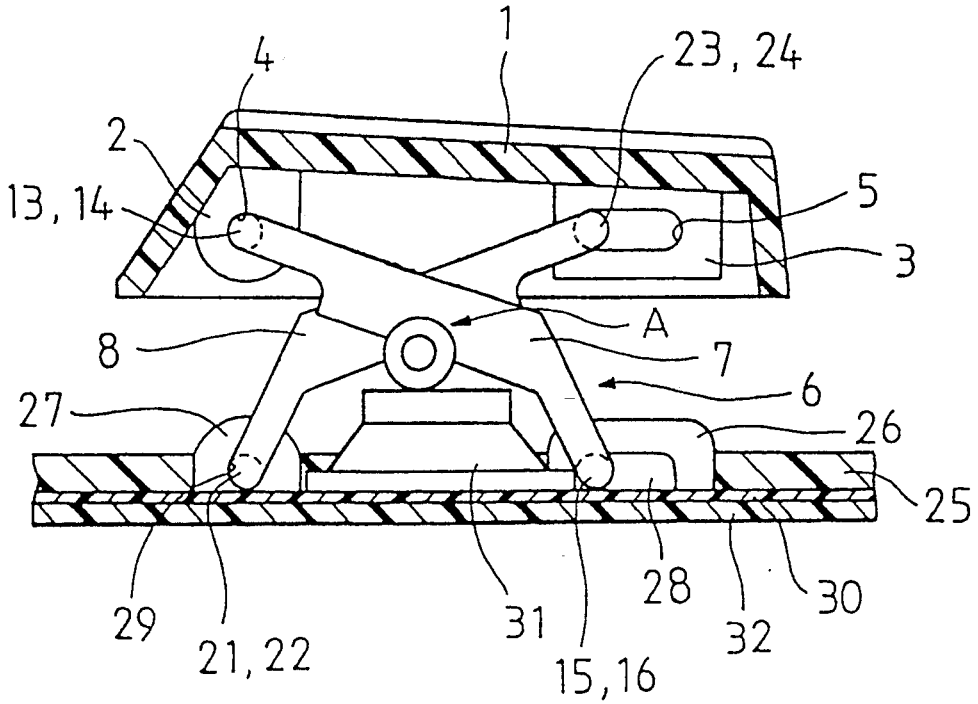
FIG. 9 PRIOR ART
FIG. 9 is a vertical sectional view of the conventional keyswitch device.
Figure 10:
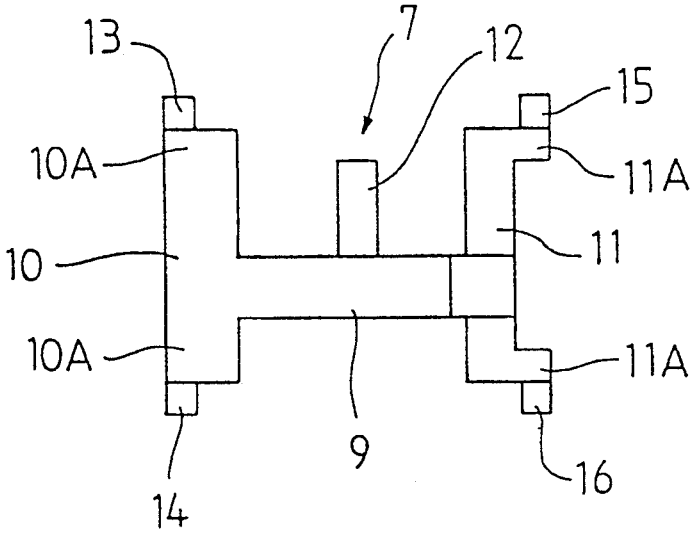
FIG. 10 PRIOR ART
FIG. 10 is a plan view of the one hinge member utilized in the conventional keyswitch device.
Figure 11:
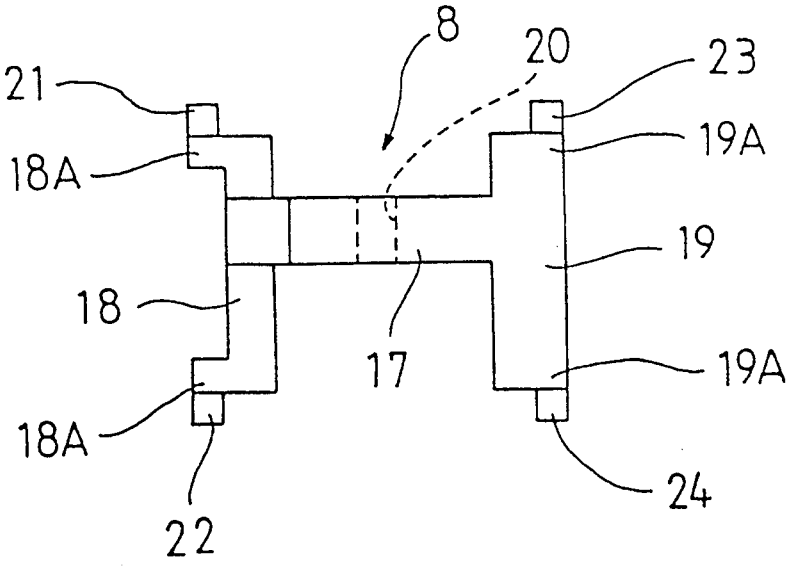
FIG. 11 PRIOR ART
FIG. 11 is a plan view of the other hinge member utilized in the conventional keyswitch device.

Next, after the engaging rod 53 of the hinge member 47 is positioned opposing to the vertical slot 44 in the holding portion 42 of the keytop 41 and the engaging pins 63, 64 of the hinge member 48 are positioned opposing to the long slot 45 in the holding portion 43 of the keytop 41, as shown in FIG. 7, the keytop 41 is slightly pressed downwardly. Based on this, the engaging rod 53 of the hinge member 47 is snapped into the vertical slot 44 while being guided through the guide portion 44A, and at the same time, the engaging pins 63, 64 of the hinge member 48 are snapped into the long slot 45 while being guided though the guide portion 45A. Such state is shown in FIG. 8. Thus, connecting action between the guide support member 46 and the keytop 41 is finished. Assembly of the keyswitch device is completed after connecting actions mentioned above.

As mentioned above, since not only connecting action of the engaging rod 53 of the hinge member 47 and the vertical slot 44 of the keytop 41 but also connecting action of the engaging pins 63, 64 of the hinge member 48 and the long slot 45 of the keytop 41 are realized only by slightly pressing the keytop 41 downwardly from the state shown in FIG. 7, connecting between the guide support member 46 and the keytop 41 can be easily and simply done.

As mentioned above, both connecting action between the hinge members 47, 48 and the holder plate 85 and connecting action between the hinge members 47, 48 and the keytop 41 can be easily done, therefore assembling time of the keyswitch device can be reduced by simplifying the assembling procedure and further the keyswitch device can be correctly assembled without affecting the assembling ability of the assembler.

Next, switching action of the keyswitch device assembled according to the above will be described hereinafter. When the keytop 41 is depressed downwardly, the engaging rod 53 of the hinge member 47 is rotated around anticlockwise direction in the vertical slot 44 according to downward movement of the keytop 41. And the engaging pins 63, 64 of the hinge member 48 are slid to the lateral direction (the rightward direction in FIG. 1) in the long slot 45 of the holding portion 43.

At the same time, the engaging rod 61 of the hinge member 48 is rotated around clockwise direction in the sliding slot 69 of the holding portion 67 formed on the holder plate 65 in cooperation with the stopper 69A. And the engaging pins 55, 56 of the hinge member 47 are slid to the lateral direction (the rightward direction in FIG. 1) in the sliding slot 68. While depressing of the keytop 41, since movement of the guide support member 46 to both the rightward and the leftward directions in FIG. 4 is limited by the guiding walls 73, it can be prevented the keytop 41 from unnecessarily getting rickety.

As a result, the support part A supporting the hinge member 47 and the hinge member 48 with each other is moved downwardly and gradually presses the rubber spring 71. And when the pressing force by the support part A is by exceeded the predetermined amount, the rubber spring 71 is buckled. Therefore, the movable electrode 71A fixed in the rubber spring 71 is contacted with the fixed electrode 70A on the flexible circuit board 70 and the switching action is conducted.

When the keytop 41 is released, the support part A of the hinge members 47, 48 is moved upwardly by elastic restoring force of the rubber spring 71. According to this, the engaging rod 53, the engaging pins 55, 56 of the hinge member 47 and the engaging rod 61, the engaging pins 63, 64 of the hinge member 48 are moved in reverse. As a result, the keytop 41 is restored to the position before depressing thereof.

Here, since the engaging rods, 53, 61 are not moved to the lateral direction but merely rotated in the vertical slot 44 and the sliding slot 69, the keytop 41 is moved to both upward and downward directions while retaining the flat state thereof without being moved to the lateral direction.

As detailedly mentioned above, in the keyswitch device of the preferred embodiment, when the keyswitch device is assembled, the engaging pins 55, 56 of the hinge member 47 and the engaging rod 61 of the hinge member 48 are slid on the holder plate 65 toward the open sides of the sliding slots 68, 69 in the holding portions 66, 67 while being guided through the guiding walls 73. Further, the engaging pins 55, 56 and the engaging rod 61 are slid until the engaging rod 61 rides over the stopper 69A formed in the sliding slot 69. Thus, the guide support member 46 and the holder plate 65 are connected with each other. Therefore, the connecting action between the guide support member 46 and the holder plate 65 can be easily done.

In particular, since the guide support member 46 is correctly guided toward the sliding slots 68, 69 through the guiding walls 73 when the guide support member 46 is slid, the guide support member 46 never gets out of the sliding slots 68, 69. Therefore, such connecting action between the guide support member 46 and the holder plate 65 can be more easily done because of the guiding walls 73.

When the guide support member 46 and the keytop 41 are connected with each other, after the engaging rod 53 of the hinge member 47 is opposed to the vertical slot 44 of the keytop 41 and the engaging pins 63, 64 of the hinge member 48 are opposed to the long slot 45 of the keytop 41, the keytop 41 is slightly pressed downwardly. According to this, the engaging rod 53 of the hinge member 47 is snapped into the vertical slot 44 while being guided through the guide portion 44A and at the same time the engaging pins 63, 64 of the hinge member 48 are snapped into the long slot 45 while being guided through the guide portion 45A. Therefore, the guide support member 46 and the keytop 41 can be easily connected with each other.

Further, in the keyswitch device assembled by easy and simple assembling action, the engaging rod 53 of the hinge member 47 is rotatably retained in the vertical slot 44 without being moved therefrom and the engaging rod 61 of the hinge member 48 is also rotatably retained in the sliding slot 69 in cooperation with the stopper 69A without being moved therefrom. Additionally, the guide support member 46 is limited to move by the pair of guiding walls 73. Therefore, keytop 41 can be prevented from moving to both the rightward and the leftward directions and both the forward and backward directions when the keytop 41 is operated. As a result, operational feeling of the keytop 41 can be considerably improved.

While the invention has been particularly shown and described with reference to preferred embodiments thereof, it will be understood by those skilled in the art that the foregoing and other changes in form and details can be made therein without departing from the spirit and scope of the invention.

For instance, though the stopper 69A is formed in sliding slot 69 of the holding portion 67 according embodiment discussed above, it can be formed in the sliding slot 68 of the holding portion 66.

What is claimed is:

1. A keyswitch device comprising:

a keytop having a pair of first holding portions and a pair of second holding portions formed on a back surface of the keytop, a holder member having a pair of third holding portions formed thereon at diagonal positions from the first holding portions, and a pair of fourth holding portions formed thereon at diagonal positions from the second holding portions, the holder member being arranged under the keytop, a guide support member for guiding the keytop in upward and downward directions, the guide support member having a first hinge member including a first engaging means for rotatably engaging the first holding portions and a second engaging means for slidably engaging the third holding portions and a second hinge member including a third engaging means for slidably engaging the second holding portions and a fourth engaging means for rotatably engaging the fourth holding portions, the first and the second hinge members being rotatably supported with each other, and a switching means for conducting switching action according to movement of the keytop adapted to be actuated upon depression of the keytop, wherein each of the third holding portions and the fourth holding portions has a sliding slot formed therein, both sliding slots opening in the same direction and both the second engaging means and the fourth engaging means are slid into the sliding slots from the same direction.

2. The keyswitch device according to claim 1, wherein each of the first holding portions has a slot for rotatably holding the first engaging means therein.

3. The keyswitch device according to claim 2, wherein each of the second holding portions has a lateral long slot for slidably holding the third engaging means therein.

4. The keyswitch device according to claim 3, wherein each of the first holding portions has a first guide portion continuously formed therefrom so as to guide the first engaging means into the slot and each of the second holding portions has a second guide portion so as to guide the third engaging means into the lateral long slot, and wherein the keytop and the guide support member are interconnected by slightly pressing the keytop downward after positioning the first guide portions over the first engaging means and the second guide portions over the third engaging means.

5. The keyswitch device according to claim 4, wherein each of the first guide portions is open at a lower end thereof so as to become gradually wider and wider in a direction away from the keytop.

6. The keyswitch device according to claim 4, wherein each of the second guide portions has an inclined surface which is outwardly inclined in a direction away from the keytop, thereby the second guide portion is tapered so that thickness thereof becomes thinner and thinner in a direction away from the keytop.

7. The keyswitch device according to claim 1, wherein the first hinge member includes a pair of first plates being mutually opposed, each of which has a first end and a second end and wherein the first engaging means is a rod formed between the first ends and the second engaging means is a pin formed at each of the second ends.

8. The keyswitch device according to claim 7, wherein each of the first plates has a shaft formed at a central position on as inner surface thereof.

9. The keyswitch device according to claim 8, wherein the second hinge member includes a pair of second plates being mutually opposed, each of which has a first end and a second end and wherein the fourth engaging means is a rod formed between the first ends and the third engaging means is a pin formed at each of the second ends.

10. The keyswitch device according to claim 9, wherein each of the second plates has a shaft hole formed at a central position on an outer surface thereof and the shafts on the first plates are rotatably supported in the shaft holes on the second plates.

11. The keyswitch device according to claim 10, wherein the switching means includes a rubber spring made of elastic rubber, a movable electrode fixed to an upper wall inside the rubber spring and a circuit board on which a fixed electrode is formed oppositely to the movable electrode.

12. The keyswitch device according to claim 11, wherein the second hinge member has a pressing rod formed between the second plates and the pressing rod is put on the rubber spring.

13. The keyswitch device according to claim 1, further comprising a stopper member formed in each of the sliding slots formed in the fourth holding portions.

14. The keyswitch device according to claim 13, wherein the stopper member has an inclined surface through which the fourth engaging means is guided into the sliding slots.

15. The keyswitch device according to claim 1, further comprising a pair of guiding walls each of which is formed between the third holding portion and the fourth holding portion on the holder member and wherein the guide support member is guided between the guiding walls when the second engaging means and the fourth engaging means are slid into the sliding slots.

16. A keyswitch device comprising:

a keytop having a pair of first holding portions each of which has a first guide portion and a pair of second holding portions each of which has a second guide portion, both the first holding portions and the second holding portions being formed on a back surface thereof, a holder member having a pair of third holding portions formed thereon at diagonal positions from the first holding portions and a pair of fourth holding portions formed thereon at diagonal positions from the second holding portions, the holder member being arranged under the keytop, a guide support member for guiding the keytop in upward and downward directions, the guide support member having a first hinge member including a first engaging means for rotatably engaging the first holding portions through the first guide portions and a second engaging means for slidably engaging the third holding portions and a second hinge member including third engaging means for slidably engaging the second holding portions through the second guide portions and a fourth engaging means for rotatably engaging the fourth holding portions, the first and the second hinge members being rotatably supported with each other, a switching means for conducting switching action according to movement of the keytop adapted to be actuated upon depression of the keytop, wherein each of the third holding portions and the fourth holding portions has a sliding slot formed therein, both slots opening in the same direction and a stopper is formed in the sliding slot of each of the fourth holding portions, and wherein both the second engaging means and the fourth engaging means are slid into the sliding slots from the same direction.

17. A keyswitch device comprising:

a keytop having a pair of first holding portions and a pair of second holding portions formed on a back surface thereof, a holder member having a pair of third holding portions formed thereon at diagonal positions from the first holding portions and a pair of fourth holding portions formed thereon at diagonal positions from the second holding portions, the holder member being arranged under the keytop, a guide support member for guiding the keytop in upward and downward directions, the guide support member having a first hinge member including a first engaging means for rotatably engaging the first holding portions and a second engaging means for slidably engaging the third holding portions and a second hinge member including a third engaging means for slidably engaging the second holding portions and a fourth engaging means for rotatably engaging the fourth holding portions, the first and the second hinge members being rotatably supported with each other, a switching means for conducting switching action according to movement of the keytop adapted to be actuated upon depression of the keytop, wherein each of the first holding portions has a slot for rotatably holding the first engaging means therein and each of the second holding portions has a lateral long slot for slidably holding the third engaging means therein, wherein each of the first holding portions has a first guide portion continuously formed therefrom to guide the first engaging means into the slot, wherein each of the first guide portions is open at a lower end thereof and becomes gradually wider in a direction away from the keytop, and each of the second holding portions has a second guide portion to guide the third engaging means into the lateral long slot, and wherein the keytop and the guide support member are interconnected by slightly pressing the keytop downward after positioning the first guide portions and the first engaging means together and the second guide portions and the third engaging means together.

18. A keyswitch device comprising:

a keytop having a pair of first holding portions and a pair of second holding portions formed on a back surface thereof, a holder member having a pair of third holding portions formed thereon at diagonal positions from the first holding portions and a pair of fourth holding portions formed thereon at diagonal positions from the second holding portions, the holder member being arranged under the keytop, a guide support member for guiding the keytop in upward and downward directions, the guide support member having a first hinge member including a first engaging means for rotatably engaging the first holding portions and a second engaging means for slidably engaging the third holding portions and a second hinge member including a third engaging means for slidably engaging the second holding portions and a fourth engaging means for rotatably engaging the fourth holding portions, the first and the second hinge members being rotatably supported with each other, a switching means for conducting switching action according to movement of the keytop adapted to be actuated upon depression of the keytop, wherein each of the first holding portions has a slot for rotatably holding the first engaging means therein and each of the second holding portions has a lateral long slot for slidably holding the third engaging means therein, wherein each of the first holding portions has a first guide portion continuously formed therefrom to guide the first engaging means into the slot and each of the second holding portions has a second guide portion to guide the third engaging means into the lateral long slot, wherein each of the second guide portions has an inclined surface that is outwardly inclined in a direction away from the keytop, thereby the second guide portion is tapered so that thickness thereof becomes thinner in a direction away from the keytop, and wherein the keytop and the guide support member are interconnected by slightly pressing the keytop downward after positioning the first guide portions and the first engaging means together and the second guide portions and the third engaging means together.

19. A process for assembling a keyswitch device including a keytop having a pair of first holding portions, each of the first holding portions having a slot and a first guide portion continuously formed therefrom, and a pair of second holding portions, each of the second holding portions having a lateral long slot and a second guide portion, both the first and the second holding portions being formed on a back surface of the keytop, a holder member having a pair of third holding portions formed thereon at diagonal positions from the first holding portions and a pair of fourth holding portions formed thereon at diagonal positions from the second holding portions, each of the third holding portions and the fourth holding portions having a sliding slot formed therein that opens in the same direction, the holder member being arranged under the keytop, a guide support member for guiding the keytop in upward and downward directions, the guide support member having a first hinge member including a first engaging mechanism and a second engaging mechanism and a second hinge member including a third engaging mechanism and a fourth engaging mechanism, the first and the second hinge members being rotatably supported with each other, and a switch that conducts switching action according to movement of the keytop adapted to be actuated upon depression of the keytop, the process comprising the steps of:

sliding the second engaging mechanism and the fourth engaging mechanism into the sliding slots from the same direction after positioning the second engaging mechanism and the fourth engaging mechanism at the sliding slots, thereby slidably engaging the second engaging mechanism into the sliding slots of the third holding portions and rotatably engaging the fourth engaging mechanism into the sliding slots of the fourth holding portions, and slightly pressing the keytop downward after positioning both the first engaging mechanism and the slots of the first holding portions and both the second engaging mechanism and the lateral long slots of the second holding portions, thereby interconnecting the keytop and the guide support member.

* * * * *